US006336281B2

(12) United States Patent
Fulton, III

(10) Patent No.: US 6,336,281 B2
(45) Date of Patent: Jan. 8, 2002

(54) HITCH MOUNTED SNOWPLOW AND METHOD OF USING SAME

(76) Inventor: Richard E. Fulton, III, 1556 Wellington Ave., Grand Junction, CO (US) 81501

( * ) Notice: Subject to any disclaimer, the term of this patent is extended or adjusted under 35 U.S.C. 154(b) by 0 days.

(21) Appl. No.: 09/785,928

(22) Filed: Feb. 16, 2001

Related U.S. Application Data

(60) Provisional application No. 60/182,758, filed on Feb. 16, 2000.

(51) Int. Cl.[7] ..... E01H 5/04

(52) U.S. Cl. ..... 37/197; 37/232; 37/268; 37/270; 172/799.5; 172/677; 172/684.5

(58) Field of Search ..... 37/197, 232, 268, 37/270; 172/799.5, 810, 811, 677, 684.5

(56) References Cited

U.S. PATENT DOCUMENTS

| | | | | |
|---|---|---|---|---|
| 1,020,727 | A | 3/1912 | Sutcliffe | |
| 3,755,930 | A | 9/1973 | Brandt et al. | 37/219 |
| 4,369,590 | A | 1/1983 | Miller | 37/231 |
| 4,403,432 | A | 9/1983 | Biance | 37/235 |
| 4,506,465 | A | 3/1985 | Johnson | 37/268 |
| 4,630,686 | A | 12/1986 | Ausmus, Jr. | 172/684.5 |
| 4,754,562 | A | 7/1988 | McGarrah et al. | 37/232 |
| 4,802,293 | A | 2/1989 | Smith | 37/268 |
| 4,907,357 | A | 3/1990 | Liienthal | 37/266 |
| 5,046,271 | A | 9/1991 | Daniels | 37/231 |
| 5,050,322 | A | 9/1991 | Burkard | 37/268 |
| 5,058,295 | A | 10/1991 | Holland | 37/268 |
| 5,136,795 | A | 8/1992 | Rosenberg | 37/233 |
| 5,207,010 | A | 5/1993 | Grossman | 37/231 |
| 5,265,355 | A | 11/1993 | Daniels | 37/231 |
| 5,285,588 | A | 2/1994 | Niemela et al. | 37/234 |
| 5,400,859 | A | 3/1995 | Harrell | 172/219 |
| 5,411,102 | A | 5/1995 | Nickels et al. | 172/781 |
| 5,485,690 | A | 1/1996 | MacQueen | 37/231 |
| 5,595,007 | A | 1/1997 | Biance | 37/268 |
| 5,806,213 | A | 9/1998 | Doornek et al. | 37/231 |
| 5,806,214 | A | 9/1998 | Behrens et al. | 37/231 |

*Primary Examiner*—Christopher J. Novosad
(74) *Attorney, Agent, or Firm*—Sheridan Ross P.C.

(57) ABSTRACT

A snowplow apparatus as adapted to attach to a vehicle having a ball hitch assembly. The snowplow apparatus has a blade assembly connected to an elongated drawbar. A frictionally activated elevating mechanism is operatively connected to the drawbar and moves between a vertical and non-vertical orientation depending upon whether elevation of the blade or contact with the blade and the ground is desired, respectively. A further aspect relates to a lateral stabilization device associated with the opposite end of the drawbar, such stabilization device coming into contact with static members operatively associated with a hitch ball such that lateral movement of the drawbar is substantially precluded due to the contact between the stabilization members and the static elements.

14 Claims, 16 Drawing Sheets

HITCH MOUNTED SNOWPLOW AND METHOD OF USING SAME

RELATED APPLICATIONS

This application claims priority from U.S. Provisional Patent Application No. 60/182,758 filed on Feb. 16, 2000. The entire disclosure of the provisional application is considered to be part of the disclosure of the accompanying application and is hereby incorporated by reference.

BACKGROUND OF THE INVENTION

Snow removal is an onerous task for many of the homeowners who live in the 50% of the U.S. that receives repetitive snowfall in amounts needing clearing. Options include snow shovels, which are time consuming and manually arduous; snow blowers, which clear only a 20-inch swath, are costly, and are ineffective in wet and heavy snows; or hire commercial snow removal services.

Various snowplows have been developed and marketed for attaching to vehicles such as cars and trucks. Typically, such plows are attached to the front of the vehicle, and are time-consuming to attach in that such plows: (a) are heavy and therefore require attachments to firm supports such as a vehicle's frame, (b) include electrical components such as motors, winches, and the like for raising and lowering the snowplow blade. Accordingly, a user must also electrically connect the snowplow to the electrical system to the vehicle in order to properly operate the snowplow.

Snowplows have also been developed for being towed behind a vehicle as well. In general, these snowplows have the same drawbacks as mentioned above for the snowplows intended to be attached to the front of a vehicle. Accordingly, it would be desirable to have a snowplow that relieves a user of much of the burden of attaching and detaching snowplows from a vehicle typically used for other purposes than plowing snow. Thus, it would be desirable to have a snowplow that is also relatively lightweight, does not require electrical vehicle modifications and/or electrical attachments, and that is straight forward to both attach and detach to a vehicle.

SUMMARY OF THE INVENTION

The snowplow of the current invention addresses and solves the problems of prior art devices and current choices, and a novel device is provided for easy, convenient, and time saving residential snow removal. Many other devices are too costly, heavy, difficult to attach/detach, and generally more than the average homeowner needs or wants. This is especially true of the front mounted snowplows commercially available. It is projected that there are over 83 million pickup trucks, vans and sport utility vehicles licensed in the U.S. in year 2000. Many of these vehicles are equipped with a trailer hitch and virtually all of them are capable of being equipped with a trailer hitch.

The present invention is a lightweight, cost-effective snowplow that is easily attached to and detached from a vehicle. The snowplow of the present invention attaches to the rear of a vehicle for plowing while being towed in a forward direction or, alternatively, plowing while the vehicle is being driven in a reverse direction. In one embodiment, the snowplow attaches to a vehicle's trailer hitch. In one embodiment of the present invention, the snowplow blade is capable of being manually or mechanically raised and lowered without electromechanical means. Further, the raising and lowering of the blade are performed without undue stress on a user as the current invention provides for friction activated mechanical elevators (hereinafter, "FAMEs") for pivoting the snowplow blade between a raised position in which plowing is not performed. Raising the snowplow blade when the snowplow is traveling in a non plowing direction is necessary to prevent spreading unplowed snow. Wheels may be provided which allow easy movement of the snowplow from storage to attachment to the vehicle. The lowering of the wheels and raising of the blade are accomplished is a simple, single motion, as is the raising of the wheels and the lowering of the blade.

Additionally, it is an aspect of the present invention that the blade attachment for attaching the blade to the snowplow attaches to the rear or non-plowing side of the blade. This provides an added advantage in that the snow being plowed can more straightforwardly flow to the edges of the blade rather than accumulating on any blade attachments projecting from the plowing side of the blade. Thus, the present invention allows the plowed snow to flow to the edges of the blade without interruption. Accordingly, this aspect of the invention allows for less strain to be put on the snowplow and accordingly, makes it easier for the snowplow to be towed. This attachment of the snowplow to the rear of the blade allows the blade to be towed in a forward direction, and pushed in a rearward direction by rotating the blade 180 degrees.

It is another aspect of the present invention that the snowplow blade may be attached to the snowplow in a manner that allows the blade to effectively plow snow over uneven terrain wherein one end of the snowplow blade is higher than the other end of the blade. That is, the blade is capable of adapting to ground surface undulations that can cause the blade to be at an angle to the horizontal.

It is an additional aspect of the present invention that the snowplow blade be lifted by friction activated mechanical elevators (FAMEs) when the snowplow motion is in a direction opposite to that used to plow the snow. In other words, if the snowplow is positioned so that it pulls snow behind the vehicle, the blade contacts the ground when the vehicle is moving in a forward plowing or pulling position, but when the vehicle reverses and travels in a rearward (non-plowing) direction, the elevators lift the blade off the surface mechanically so that the blade is suspended over the surface a few inches. Alternatively, if the snowplow blade is positioned so that it pushes or plows snow behind the vehicle when the vehicle is moving in a rearward (plowing) direction, the elevators lift the blade off the surface mechanically when the vehicle moves in a forward or nonplowing direction. This is accomplished without removing the elevators and reversing them. There are prior art devices that are used as jacks to elevate camping trailers, and even to elevate a snowplow. The former do not slide and the latter do not engage or slide in either direction as does the bi-directional friction activated mechanical elevators of the current invention. The novel bi-directionality of the elevators is necessary to easily operate the snowplow of the current invention in either forward or rearward directions. An alternative embodiment utilizes mechanical elevators attached to the rear of the snowplow which contain a novel shape which allow the snowplow to slide on the elevators in the raised position from side to side as well as forward and rearward.

Because the snowplow of the current invention is positioned behind the car and is rigidly attached to the car, there is significant lateral or oblique movement of the snowplow when the front wheels are turned. This is not problematic when the plow is plowing and engaged with the ground, but when the vehicle is reversed engaging the FAMEs with the ground, they must be able to slide obliquely especially when the front wheels are turned. The current invention does provide for novel shoes or skid plates and means to accommodate the lateral forces generated by the oblique or lateral movement.

Still another aspect of the present invention is to provide a novel lateral stabilizing device to prevent the snowplow from rotating on the hitch ball in a plane horizontal to the ground, while allowing motion in a plane vertical to the ground. This lateral stabilizing device attaches to the hitch bar and not the bumper or car frame, as is the case in other prior art devices. As such, the present invention represents an improvement over prior art devices in functionality and ease of use.

In other embodiments, another aspect of the present invention is that the snowplow is capable of plowing snow in forward and rearward directions of various angles.

Collectively, it is an aspect of the present invention that the snowplow be easy to attach, simple to use, effective at removing snow, easy to detach, and relatively inexpensive. This is possible because of novel means of creating lateral stabilization of the snowplow while using a standard trailer hitch, novel friction activated mechanical elevators, and a novel snowplow which can plow in either forward or rearward direction. The ease of attachment with the trailer hitch and the lack of expensive electromechanical means to elevate the plow enable the average homeowner to easily attach and use the snowplow of the current invention with any vehicle capable of being fitted with a standard trailer hitch.

One embodiment of the present invention is directed to a snowplow apparatus adapted to be attached to a vehicle having a ball hitch assembly. A blade assembly is provided having a front face for effecting displacement of snow accumulated on the ground surface over which the blade assembly is caused to traverse, such blade assembly having a blade support assembly operatively attached to the back face of the blade assembly. At least two skid members are preferably operatively associated with a ground contacting portion of the blade. One end of an elongated drawbar is operatively associated with the ball hitch assembly and its other end is operatively associated with the blade support assembly. The blade support assembly preferably comprises a blade angulation plate rotationally associated with the drawbar, enabling the blade to be moved and fixed in a desired angular orientation.

A frictionally activated elevating mechanism, preferably having a handle associated therewith, is pivotally connected to the drawbar. The bottom end of the elevating mechanism preferably has a hardened plastic extension associated therewith for contacting the ground surface. The frictionally activated extension is movable between a vertical position wherein the blade is elevated off the ground, and a second non-vertical orientation wherein the blade contacts the ground.

A lateral stabilization device is operatively associated with one end of the drawbar. The stabilization apparatus has first and second stabilization members positioned approximately equal distance from the drawbar and substantially parallel therewith, such members positioned adjacent to the hitch assembly. The lateral stabilization device does not substantially preclude movement of the longitudinal drawbar in a vertical direction during a plowing operation and further provides for fixed angular orientation of the drawbar.

A hitch ball is operatively associated with a horizontal member which has first and second static elements configured to engage the first and second stabilization members when the ball hitch assembly is operatively associated with the hitch ball. Lateral movement (but not vertical movement) of the longitudinal drawbar is substantially precluded due to the contact between the first and second stabilization members and the first and second static elements. In a preferred embodiment, the blade can be rotated 180° and fixed in place to facilitate plowing when the vehicle is moved in either a rearward or forward direction. A wheel assembly can be operatively associated with the elevator to facilitate transport of the snowplow when not in use. A spring connecting the blade to the blade support assembly facilitates pivotable movement of the blade when the blade contacts obstacles during a plowing operation. In other embodiments, the elevator is operatively associated with the second back face of the blade, rather than being pivotally connected directly to the drawbar.

The present invention also encompasses a method for performing a snowplowing operation, comprising providing a blade assembly having a front face for effecting displacement of snow and a second back face having a blade support assembly operatively attached thereto; providing an elongated drawbar having a first end operatively associated with a ball hitch assembly and a second end being operatively associated with the blade support assembly; providing a frictionally activated elevating mechanism pivotally connected to the back face of the blade and being movable between a vertical position wherein the blade is elevated off the ground, and a non-vertical orientation wherein the blade contacts the ground; providing a lateral stabilization device operatively associated with the first end of the drawbar which has stabilization members positioned approximately equal distance from the drawbar and substantially parallel therewith and adjacent the hitch assembly; providing a hitch ball operatively associated with hitch ball static elements configured to contact or otherwise engage the stabilization members when the ball hitch assembly is operatively associated with the hitch ball, whereby lateral movement of the longitudinal drawbar is substantially precluded due to the contact between the stabilization members and the static elements; and bringing the blade into contact with snow to be plowed and conveying the vehicle in a direction to accomplish the plowing operation.

Other aspects and features of the present invention will become evident from the detailed description and accompanying drawings provided herein.

BRIEF DESCRIPTION OF THE DRAWINGS

FIG. 5 shows a perspective view of the snowplow 20 of the present invention, including the ball 17 and hitch 13 and the lateral stabilizing features 14*a,b*.

DETAILED DESCRIPTION

Figure 1:
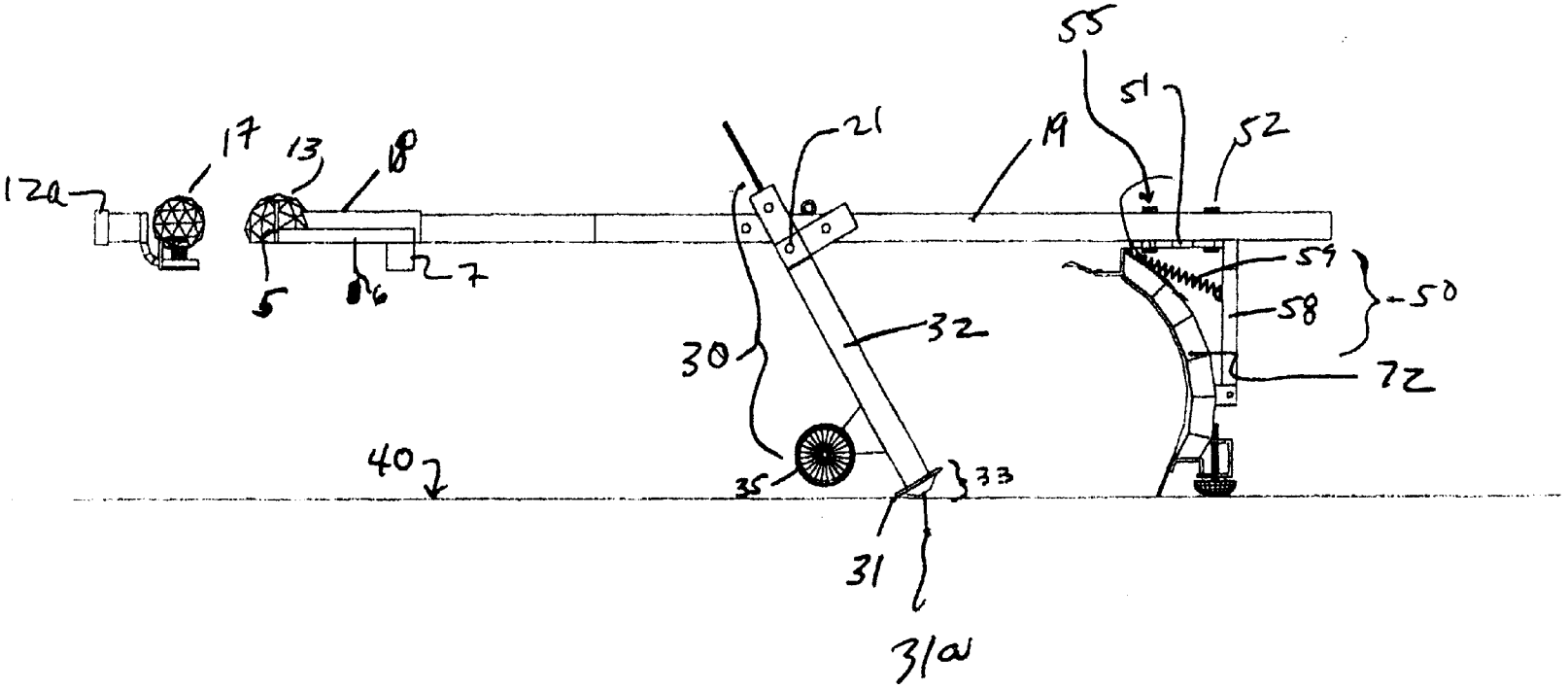
FIG. 1 shows a side view of the snowplow 20 of the present invention.
Figure 8:
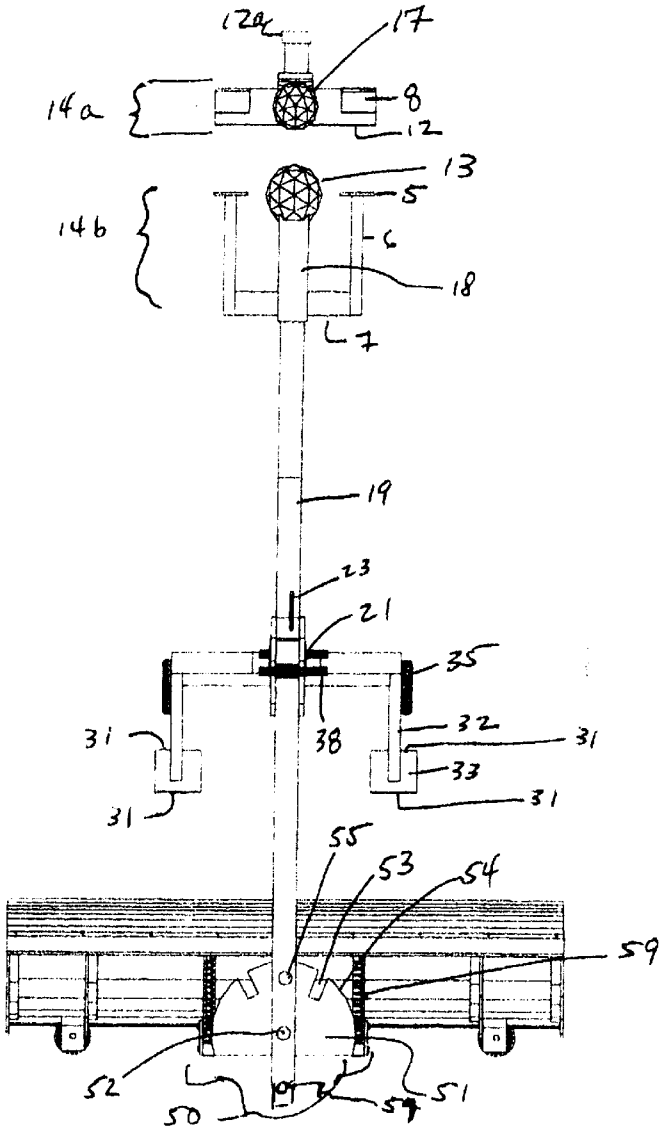
FIG. 8 shows a top view of snowplow 20 of the present invention and the hitch bar 12*a* and hitch ball 17.

Referring to FIGS. 1 and 8, a preferred embodiment of the snowplow 20 of the present invention is shown. FIG. 1 shows the snowplow 20 not attached to the hitch ball 17. The hitch ball 17 is attached to a hitch bar that is inserted into a conventional trailer hitch sleeve 12*a* or receiver 12*a* attached to the rear of a vehicle. To operate snowplow 20, the coupler hitch 13 on the drawbar 18 is placed over the hitch ball 17 and secured by a suitable releasable locking mechanism (not shown.) The snowplow 20 can then either be pulled by moving the vehicle in a forward direction, or it can be pushed by moving the vehicle in a rearward direction. The snowplow blade 72 can be oriented in a forward facing direction (as shown) for plowing snow in a forward direction (i.e., when the vehicle is moving forward), and oriented in a rear facing direction for plowing snow in a rearward (reverse) direction. Alternatively, the snowplow blade 72 may be angled to either side in either a forward or rearward orientation.

FIG. 1 also demonstrates the lateral stabilizing mechanism of the ball 14*a* and hitch 14*b* which will be described in more detail below. In one embodiment, the longitudinal drawbar member 19 supports the lateral stabilizing mechanism of the hitch 14*b*, the bi-directional friction activated mechanical elevators (FAME) 30, and the snowplow blade support 50 and locking mechanism 52. The snowplow 20 as shown in FIG. 1 is in a configuration for plowing. The hitch 13 is placed on the ball 17 and secured, and the vehicle driven in a forward direction. The FAME 30 is pivotally attached to the under surface of the longitudinal drawbar 19. The forward direction causes the legs 32 of the FAME 30 to be directed rearward because of friction on the ground 40, pavement 40, or other surface 40. This is the normal position of the FAME 30 when plowing in a forward direction. The embodiment pictured in FIG. 1 is shown not attached to the rear of a vehicle, however the snowplow blade 72 is in a lowered position for thereby plowing snow. The blade 72 is positioned so that it will plow snow in a forward direction behind a vehicle. The bi-directional friction activated mechanical elevators (FAME) 30 simply drag along on the ground 40 or snow 40.

It is desirable to raise the blade 72 off the snow 40 or surface 40 when not plowing snow as the blade 72 would otherwise push or displace snow in sub optimal and unwanted directions. The maneuverability of the snowplow 20 would also be limited. The snowplow of the current invention provides a means of elevating the snowplow blade by pivotally attaching the FAME 30 to any position on the drawbar 19, such as the middle portion of the longitudinal drawbar 19. This location of the pivot point serves to raise the snowplow blade higher than if the FAME 30 or similar device were attached to the blade 72. Also, by attaching the FAME 30 to the drawbar 19 instead of the blade 72, the blade 72 is able to be angulated to either side without changing the orientation of the shoes 33 of the FAME 30. A preferred design of the shoes 33 of the FAME 30 comprises a frictional component 31 and a slidable component 28. The frictional component 31 extends forward and rearward of the slideable component 31*a* so that it engages the ground when the legs 32 of the FAME 30 are angled to the front or rear. Preferentially the lips 31 of the frictional component 31*a* are made of metal and the slideable component 28 is made of plastic (e.g., ultrahigh molecular weight polyethylene) or, alternatively, is configured with turned up edges to facilitate sliding over the ground surface. This arrangement allows friction when needed to engage the ground and pivot the FAME 30 to a vertical position, thus elevating the blade 20 above the ground 40, and a surface of less friction needed to slide the device along with the blade 72 when in a plowing orientation.

Figure 2:
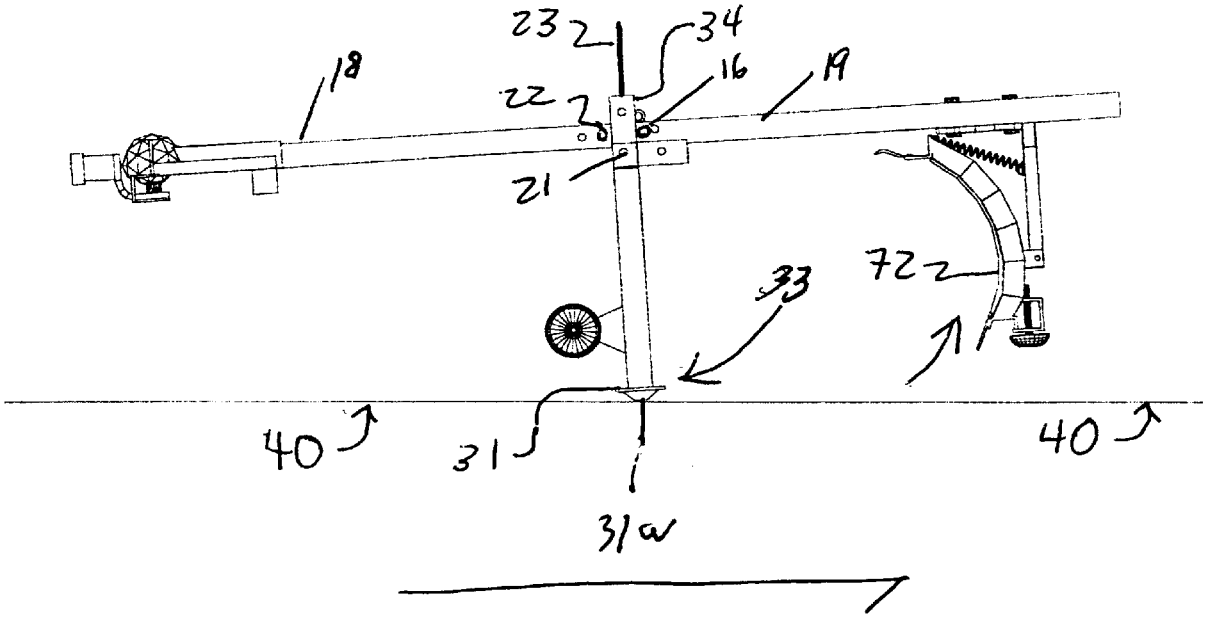
FIG. 2 shows the snowplow 20 with the snowplow blade 72 in a raised position wherein it is not used for plowing snow.

FIG. 2 demonstrates the elevating action of the FAME 30. As the vehicle is reversed and driven rearward, the forward lips 31 of the shoes 33 of the FAME 30 contact the surface 40 being plowed, and the friction between the lips 31 of the shoes 33 and the surface 40 prevent the shoes 33 of the FAME 30 from sliding along the surface 40, and instead, cause the legs 32 to move/pivot into a substantially vertical orientation (approximately perpendicular to the ground 40) thus elevating the blade 72 off the ground 40. This action stabilizes the position of the shoes 33 while the longitudinal drawbar 19 is moving rearward. As shown in FIG. 2, the edge 31 of the bi-directional friction activated mechanical elevators 30 has engaged the ground 40 causing the limb 32 of the FAME 30 to become oriented vertical to the longitudinal drawbar 19. The latch pin 16 in hole 16*a* of the longitudinal drawbar 19 prevents the limb 32 of the FAME 30 from rotating past the vertical orientation with respect to the longitudinal bar 19. This action elevates the blade 72 as the proximal end 18 of the snowplow 20 is pivotally attached to the hitch ball 17. Because the length of the legs 32 of the FAME 30 are longer than the height of the snowplow blade 72 and support apparatus 51, and because the forward portion 18 of the drawbar 19 is attached to the vehicle by the ball 17 and hitch 13, the rear of the longitudinal drawbar 19 and the snowplow blade 72 are elevated when the FAME 30 assumes a more or less vertical orientation. A latch pin 16 placed within a hole 16*a* through the drawbar 19 just rearward of the pivot point 21 prevents the FAME 30 from rotating past the vertical orientation as shown in FIG. 2. The snowplow 20 then slides along on the shoes 33 of the FAME with the snowplow blade 72 elevated while the vehicle is moving in a rearward direction. When the vehicle begins to travel in a forward direction, the forward edges 31 of the shoes 33 of the FAME 30 rock forward and contact the ground 40. The friction between the edges 31, or lips 31, of the shoes 33 and the ground 40 or surface 40 does not allow the shoes 33 to slide in a forward direction. In other words, when the vehicle starts moving in a forward (plowing) direction, the leg 32 pivots out of the vertical orientation, thus causing the blade 72 to descend and contact the ground 40. The leg 32 is then in an angled orientation towards the blade 72 and skims along the ground 40. As the snowplow 20 moves forward, it causes the FAME to angulate, lose vertical height, and thereby lower the snowplow blade 72 into position for plowing snow.

Alternatively, if the blade 72 of the snowplow 20 is directed in a rearward direction, and plowing is done by driving the vehicle in a reverse or rearward direction, the legs 32 of the FAME 30 rotate forward so that they are angled toward the hitch 13 and the blade 72 is lowered into contact with the ground 40. The shoes 33 then trail along in that position on the surface 40 until the vehicle is driven in a forward direction, at which time friction with the ground 40 causes the leg 32 to move into a substantially vertical orientation, lifting the blade 72 off the ground 40. The forward direction of the drawbar 19 and the fixed position of the shoes 33 causes the legs 32 of the FAME 30 to assume a vertical position, raising the snowplow blade 72. A latch pin 16 placed through the drawbar 19 just forward of the pivot point 21 of the FAME 30 prevents the FAME 30, and particularly the leg 32, from rotating past a substantially vertical orientation. The snowplow 20 slides along on the shoes 33 of the FAME 30 when the vehicle is traveling in a forward direction. When the vehicle reverses and travels in a rearward (plowing) direction, the shoes 33 of the FAME 30 rock back toward the rear edge 31 of the shoes 33, causing the legs 32 of the FAME 30 to angulate away from the blade 72 so that the snowplow blade 72 is lowered and plows snow.

Figure 3:
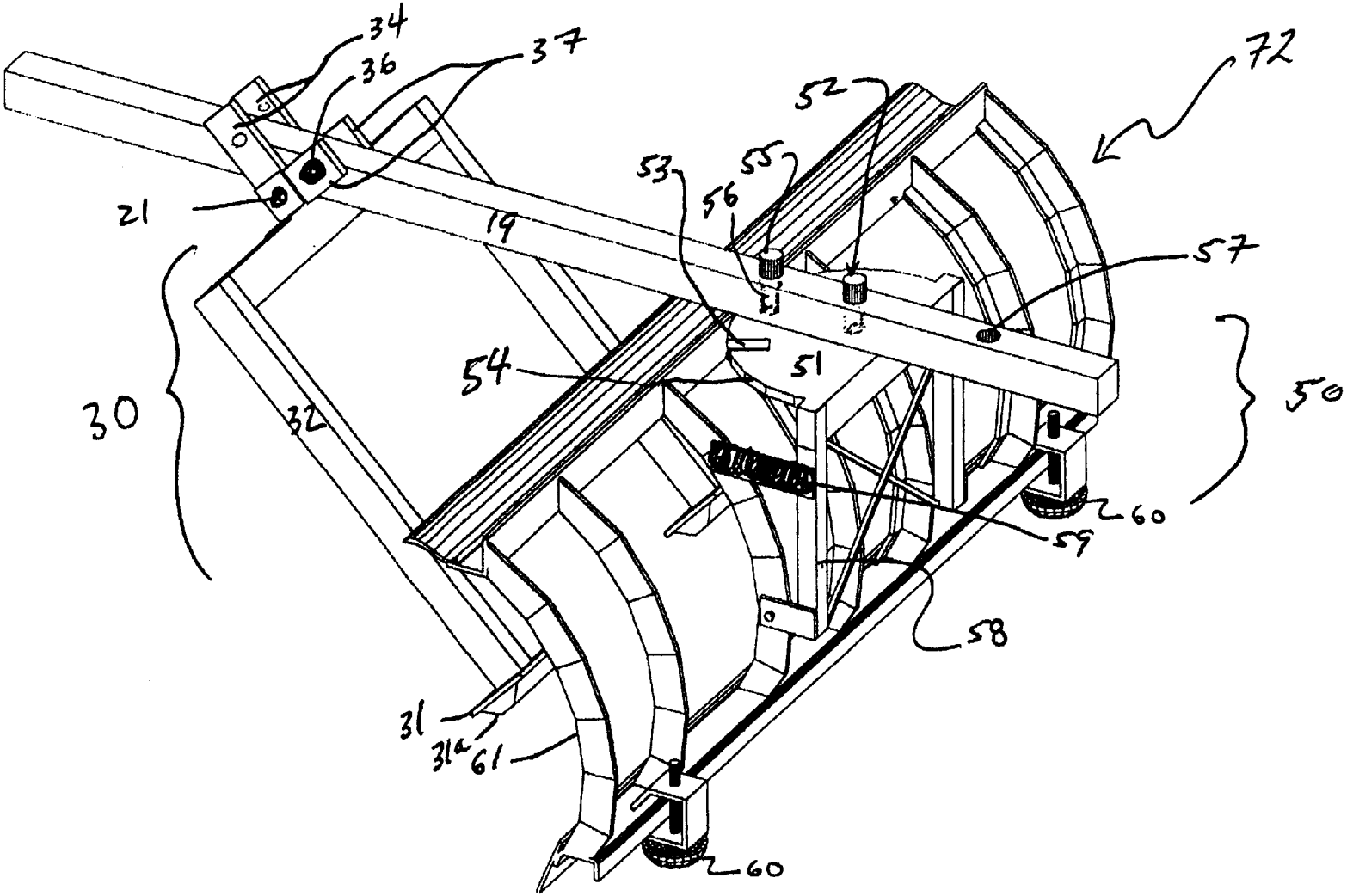
FIG. 3 shows a perspective view of the snowplow 20 of the present invention, excluding the hitch and the lateral stabilizing features.

FIG. 3 illustrates the snowplow blade 72 and blade support apparatus 50. The longitudinal drawbar 19 is pivotally attached to a horizontally oriented plate 51 by a bolt 52 directed vertically through the drawbar 19 and through the plate 51. The plate 51 contains indentations 53 or notches 53 within one radiused margin 54. A latch pin 55 is placed through a vertically directed hole with in the drawbar 19 and through these notches 53 to affix the orientation of the snowplow blade 72 in a forward direction or angled directions. If the snowplow blade 72 is oriented rearward, the latch pin 55 is placed through a second vertically oriented hole 57, located rearward of the pivotal attachment bolt 52 in the longitudinal drawbar 19. Therefore, forward or rearward plowing can be accomplished by simply rotating the snowplow blade 72 and placing the latch pin 55 in the appropriate hole 56,57.

The horizontally (in relation to the ground) oriented plate 51 is rigidly attached to vertical members 58 which are pivotally attached to the snowplow blade 72. Further, the vertical members 58 are attached to the upper portion of the snowplow blade 72 by trip springs 59. FIG. 3 also demonstrates adjustable skids 60, the ribs 61 of the snowplow blade 72 frame and the FAME 30.

Figure 4:
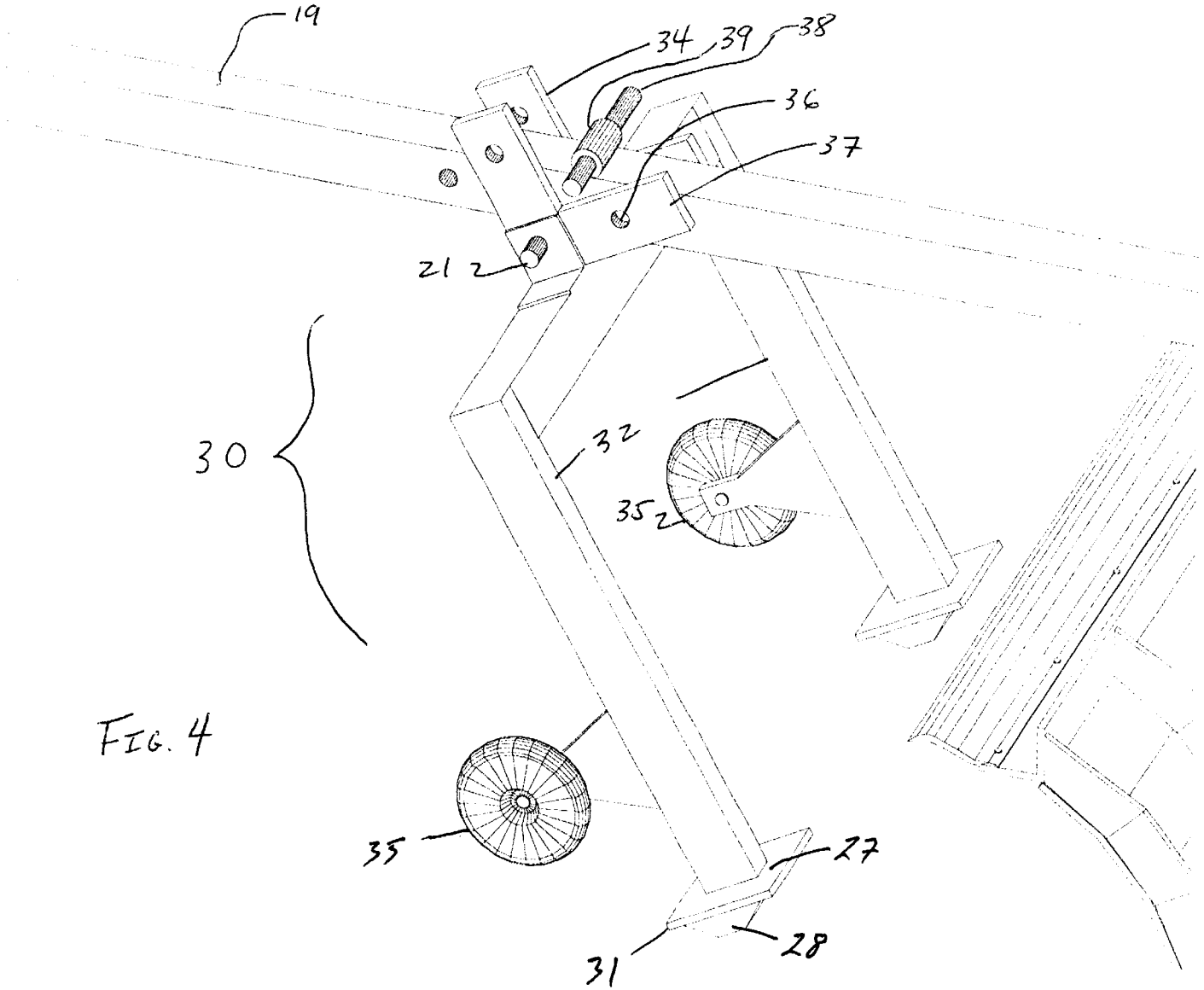
FIG. 4 shows a perspective of the attachment of the raising assembly 30, or the bi-directional FAME 30, that pivotally attaches to the longitudinal drawbar 19.
Figure 3:
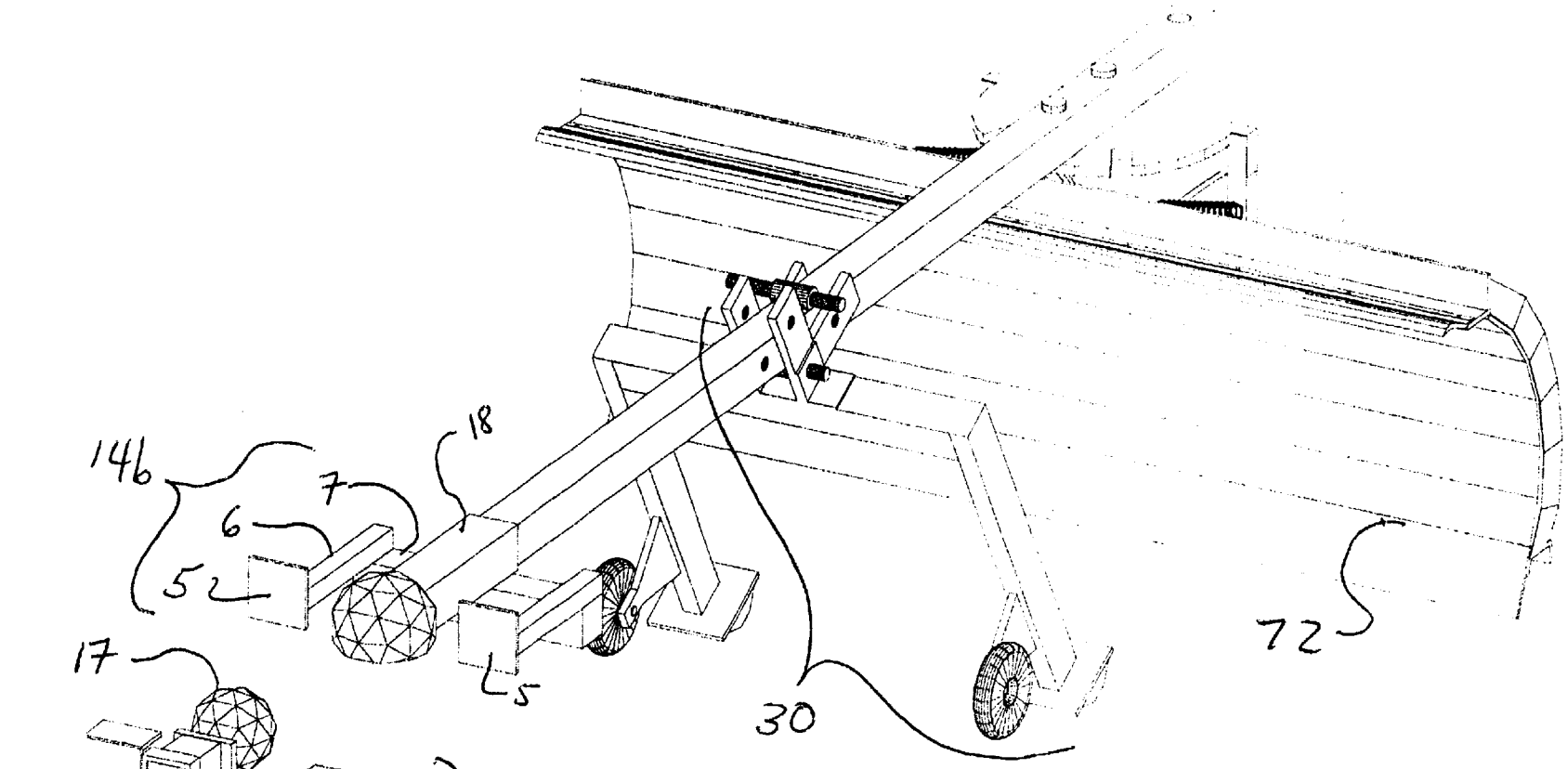

In the embodiment shown in FIG. 4, the shoes 33 of the FAME 30 are constructed of a rigid plate 27 with edges or lips 31 and a smaller extended slideable member 28 fixably attached to the undersurface of the plate 27. This smaller member 28 is preferably constructed of UHMW polyethylene, a very hard polymer which slides readily, and quietly, over various surfaces. Therefore, by simply placing a latch pin 16 in a hole immediately forward or rearward of the pivot point 21 of the FAME 30, one can cause the FAME 30 to engage and elevate the snowplow blade 72 in either a forward or rearward direction without resorting to expensive hydraulic pistons, winches, or the like. Therefore, the bi-directional friction activated mechanical elevators will maintain the functionality of the snowplow and obviate the weight, expense, and burdensome connections associated with electromechanical means of elevating the snowplow.

FIG. 4 shows a detailed perspective view of the attachment of the FAME 30 to the longitudinal drawbar 19. A bolt 21 through the attachment arms 34 of the FAME 30 is pivotally attached to the drawbar 19 by a length of tubing welded to the undersurface of the drawbar 19. A latch pin is inserted through a hole in drawbar 19 to prevent rotation of the FAME 30 past vertical when the snowplow 20 moves in a rearward direction. Another hole is placed within the drawbar 19 just rearward of the bolt 21. This hole is utilized with a latch pin 16 to prevent rotation of the FAME 30 past vertical when the snowplow 20 moves in a forward direction.

Although the present invention in many embodiments, entails a combination of various novel features, including a unique horizontal hitch stabilization device and a unique friction activated elevator, it also encompasses other novel combinations that involve the use of previously known mechanisms. For example, the novel horizontal stabilizer may be used in combination with known mechanical elevating devices. For instance, U.S. Pat. No. 5,050,322 to Burkard is incorporated by reference herein in its entirety. It is important to note, however, that although Burkard discloses the use of an automatically operable lift mechanism, there are various important differences between Burkard's device and the preferred embodiment of the present invention. For example, in some embodiments, the present invention does not require two friction activated mechanical elevators, as is the case with Burkard. Moreover, the pivoting elongated struts used by Burkard cannot be directly connected to a longitudinal drawbar, but rather, are pivotally connected to the rear of a snowplow blade. Nor does Burkard teach or suggest the use of hardened plastic skid elements to contact the ground when not performing a plowing operation, nor a ground grabbing member (e.g., lip of a skid plate) that facilitates desired engagement of the elevator to move it into a vertical orientation. Perhaps most importantly, however, the Burkard snowplow apparatus is only suitable for plowing operations when moving a vehicle in a reverse direction. Thus, unlike the present invention which can be used with both rearward and forward moving vehicles to perform a plowing operation, Burkard's device does not permit plowing while a vehicle is moving in a forward direction, and as such, does not teach a method or device that facilitates lifting of a snowplow blade when reversing the vehicle. Nor does the Burkard snowplow apparatus facilitate the relatively easy 180° change in blade orientation made possible by the present invention to facilitate bi-directional plowing operations. The bi-directional features of the FAME 30 are therefore novel and unique. Moreover, Burkard teaches trailing sections of skids having significant curvature. This shape, while suitable to slide over the ground once the strut is vertical, is problematic with respect to attaining the vertical position in the first place. Burkard's curved skids are not believed to engage properly or consistently when required to elevate the snowplow. As such, it is believed that Burkard's design is deficient in that the desired pivoting into a vertical arrangement is hindered by the smooth curved surfaces which allows the angled, non-vertical orientation of the strut to persist even when the vehicle is moving in a non-plowing direction, thus causing undesired contact between the blade and the ground. Moreover, Burkard relies upon cables which connect to bumpers in a widely spaced orientation in order to control movement of an elongated tongue. No such cables are utilized in the present invention, nor are contacts directly with a vehicle's bumper required nor desired. Burkard also teaches the use of a pair of elongated struts formed from metal tubes having a diameter in the order of 2 inches which are pivotally inner connected with an adjusting bracket affiliated with a snowplow. No such structure is necessary using the present invention. Finally, Burkard teaches the use of lift units having skids with front and back sides turned up away from the ground. Burkard does not teach the curved up side portions of a skid as does the present invention in many embodiments. Thus, Burkard's device with the skids as shown would not be suitable for many of the plowing operations wherein angular positioning of the drawbar, and thus the snowplow, in relation to the vehicle, are contemplated. The skids used in the present invention are turned up at appropriate edges, not necessarily the front or back of a skid, in order to facilitate various angular plowing operations.

A lever handle 23 may be attached to the top of the arms 34 of the FAME 30 to facilitate rotation of the FAME 30 to the desired position before plowing, and to deploy the wheels 35 to facilitate transport when not in use. A third hole 36 within sidearms 37 is utilized to secure the FAME 30 in a position so that the wheels 35 contact the ground 40. A latch pin 38 is placed through the holes in sidearm 37 and through the sleeve 39 attached to the drawbar 19. The snowplow 20 can then be towed by the vehicle. This position also allows for easy manual transport, positioning, and attachment of the snowplow 20, as well as easy detachment, manual transport, and storage of the snowplow 20 after use.

Figure 6:
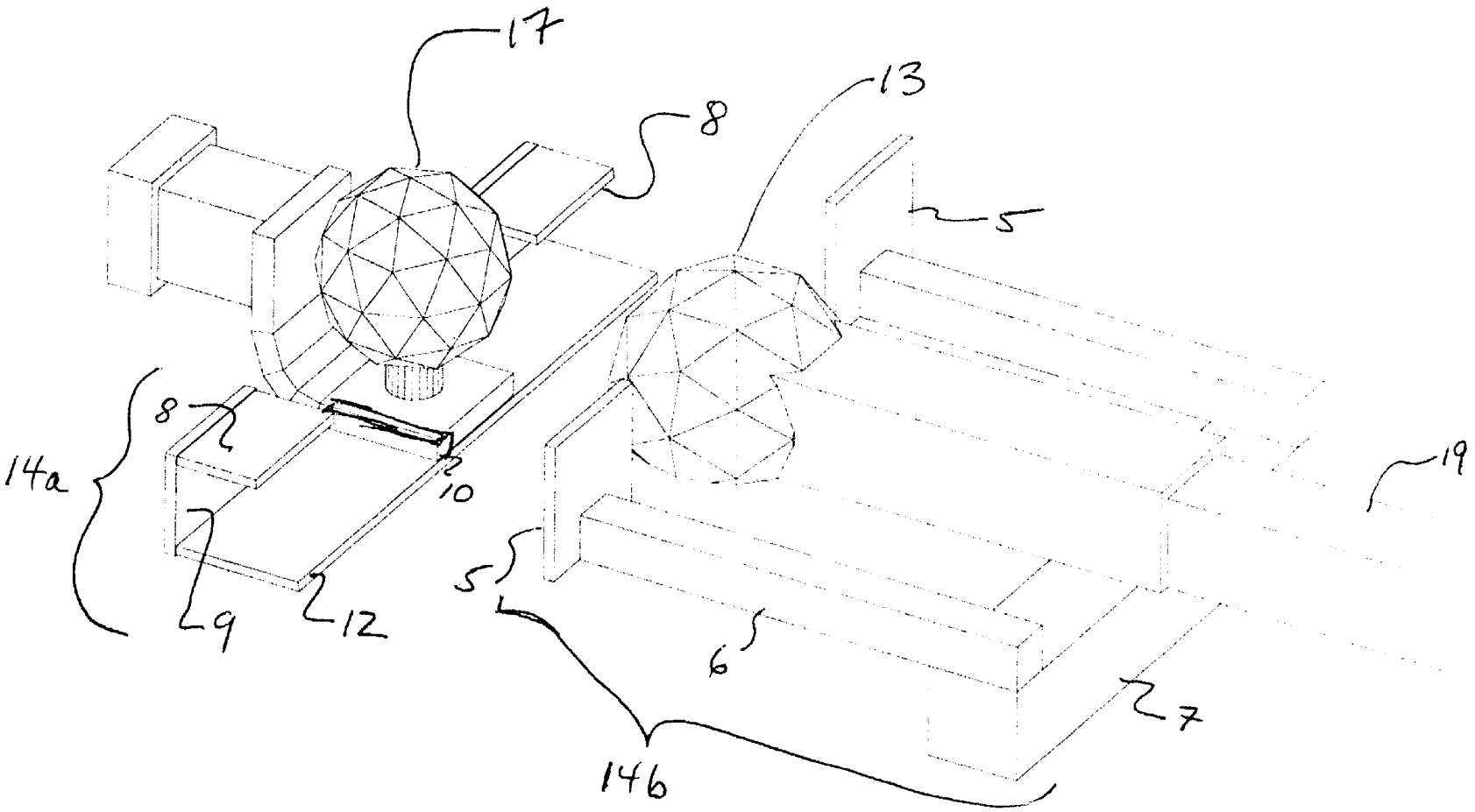
FIG. 6 shows a perspective view of the ball 17 and hitch 13 and the lateral stabilizing features and components 14*a,b*.
Figure 7:
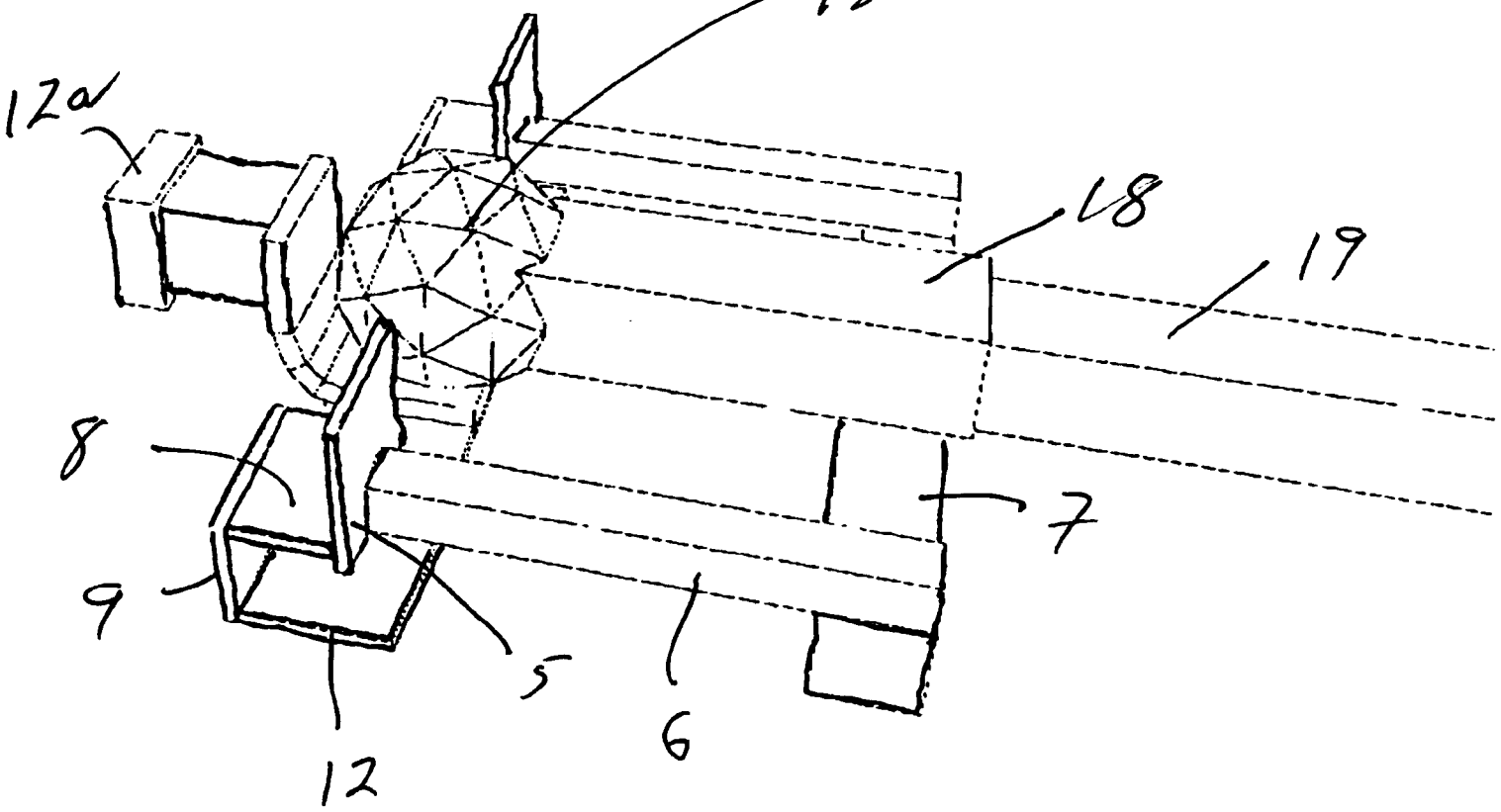
FIG. 7 shows a perspective view of the hitch 13 on the ball 17 with the lateral stabilizing features and components approximated.

FIGS. 5, 6, and 7 illustrate the novel lateral stabilization apparatus 14*a,b*, which is an integral part of the snowplow of the current invention. The ball and hitch are the most convenient means of attaching a trailerable device to a vehicle. In the case of a snowplow, it is desirable to maintain a vertical pivoting motion, but to eliminate the lateral, or side-to-side, motion allowed by the ball and hitch. Prior art rear hitch snowplows stabilize the plow to prevent lateral motion by attaching bars, rods, or chains to the vehicle. This is not only inconvenient in many cases, but also next to impossible in other instances as modern vehicles do not have bumpers of sufficient strength to withstand the considerable forces of the plow. Moreover, attaching the stabilizing device to the undercarriage or frame of the vehicle is burdensome, may create a need to install a custom fitting on the frame, or the stabilizing element may actually damage the bumper. The stabilizing device of the current invention solves these problems by providing a lateral stabilizer 14*a* which is attached directly to the hitch bar 11 or directly into the hitch receiver 12*a*, not the vehicle. Corresponding stabilizing members 14*b* are attached to the drawbar 18 which abut the hitch bar 11 based stabilizing elements 14*a* when the coupler hitch 13 of the drawbar 18 is placed over the ball 17. Therefore, there is no need to separately attach a stabilizing device to the vehicle, as the stabilizing components of the current invention 14*a*,b are placed in correct position by the simple act of placing the drawbar coupler hitch 13 on the ball 17.

As shown in FIGS. 5, 6, and 7, the present invention prevents lateral rotation or movement of the snowplow by providing members 42*a,b* that project to the side of the ball 17 and hitch 13 that allow vertical pivoting but do not allow pivoting horizontally. In fact, the members 42*a,b* prevent any pivoting other than vertical and a few degrees off vertical. Horizontal member 12 is bolted under the hitch bar 11 that supports the ball 17. The shank of the ball 17 is directed vertically through the hitch bar 11 and through the horizontal bar 12. As shown in FIG. 6, members 10 are welded to the top of horizontal arm 12 adjacent to the sides of hitch bar 11 to prevent rotation of horizontal arm 12 with respect to hitch bar 12*a*. Vertical members 9 support second horizontal members 8. The second horizontal members 8 are positioned so that the plane occupied by the second horizontal members 8 occupy the horizontal plane of the center of the ball 17. The edge 8*a* of horizontal members 8 also are positioned so that they do not protrude beyond the vertical or coronal plane of the ball. This orientation is critical to the proper function of the lateral stabilization device 14*a,b* and the snowplow in the preferred embodiment. Alternative orientations (not shown) may be utilized to limit the vertical travel of the drawbar 18,19 and the snowplow 20.

The drawbar 19 also is provided with horizontal members 7 that are attached to longitudinal oriented members 6 parallel to the drawbar 19. These longitudinal members 6 are affixed to vertically oriented plate-like members 5. When the hitch 13 is placed onto the ball 17, the second horizontal members 8 of the hitch bar apparatus 14*a* approximates the vertically oriented plate-like members 5 of the drawbar 19 as shown in FIG. 7. This approximation prevents any side-to-side movement of the drawbar 19 and snowplow 20 with respect to the hitch bar 12*a* and the vehicle. This arrangement does allow for vertical pivoting of the drawbar 19 and snowplow 20 relative to the hitch bar 12*a* and the vehicle, which is necessary for the snowplow 20 to maintain contact with the plowed surface 40.

As shown in FIG. 7, some embodiments of the present invention will allow pivoting of the snowplow 20 in a vertical plane, but will not allow pivoting on the ball 17 in a horizontal plane or in those planes that are not essentially vertical.

Figure 9:
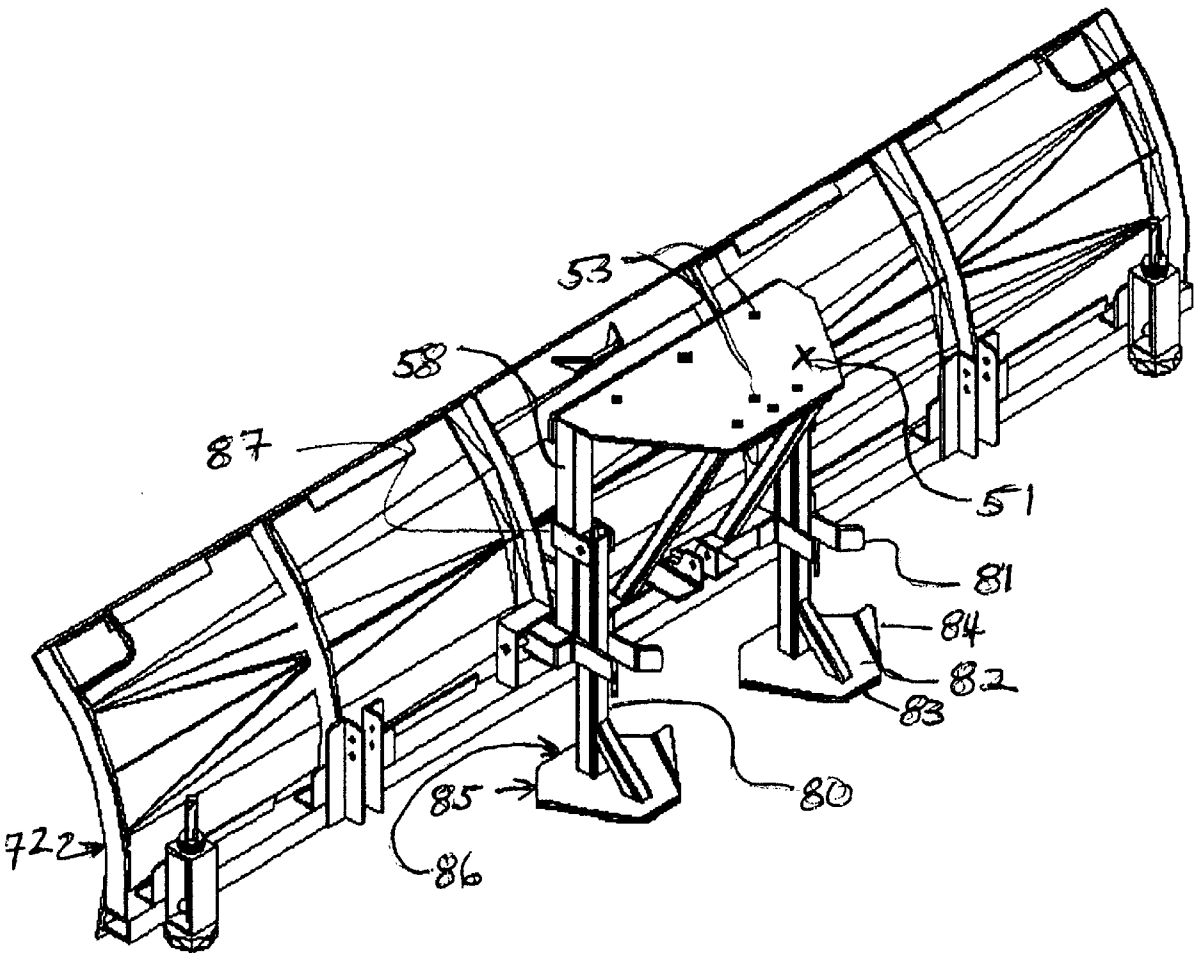
FIG. 9 is a rear perspective view of the snowplow blade of the present invention with frictional activated mechanical elevators illustrated.

FIG. 9 illustrates an alternative embodiment of the FAME. In this embodiment, the FAME is attached to the rear of the snowplow, and does not have bi-directionality as it will be correctly oriented to the blade 72 no matter what the direction of the blade face 72. It is attached to the snowplow housing 50, which in turn is attached to the blade 72. Struts 81 along a vertical member 58 of the snowplow housing 50 accommodate the lateral and oblique forces generated when the vehicle is turned and the blade 72 is elevated on the skids 82. The leading edges of the skid plates 82 are turned so that they will readily slide in a forward/rearward direction and also in oblique and lateral directions. The toe 83 of the skid plate 82 is turned up, as are the leading sides 84. The rear of the skid plate not only provides a flat surface 86 to provide friction to engage the FAMEs, but also angled sections 85 which engage the FAMEs when the blade is angled or when the vehicle is turned. These two features, i.e., the struts 81, which provide support against lateral movement and against forces on the arm 80 of the FAME, and the shape of the skid plate 82, are novel and have not been described or utilized before in snowplows or other applications. As one will appreciate, the ground contacting surface of the skis 82 may be fitted with hard plastic members to facilitate sliding over the ground once the fame legs are in a vertical orientation.

Figure 10:
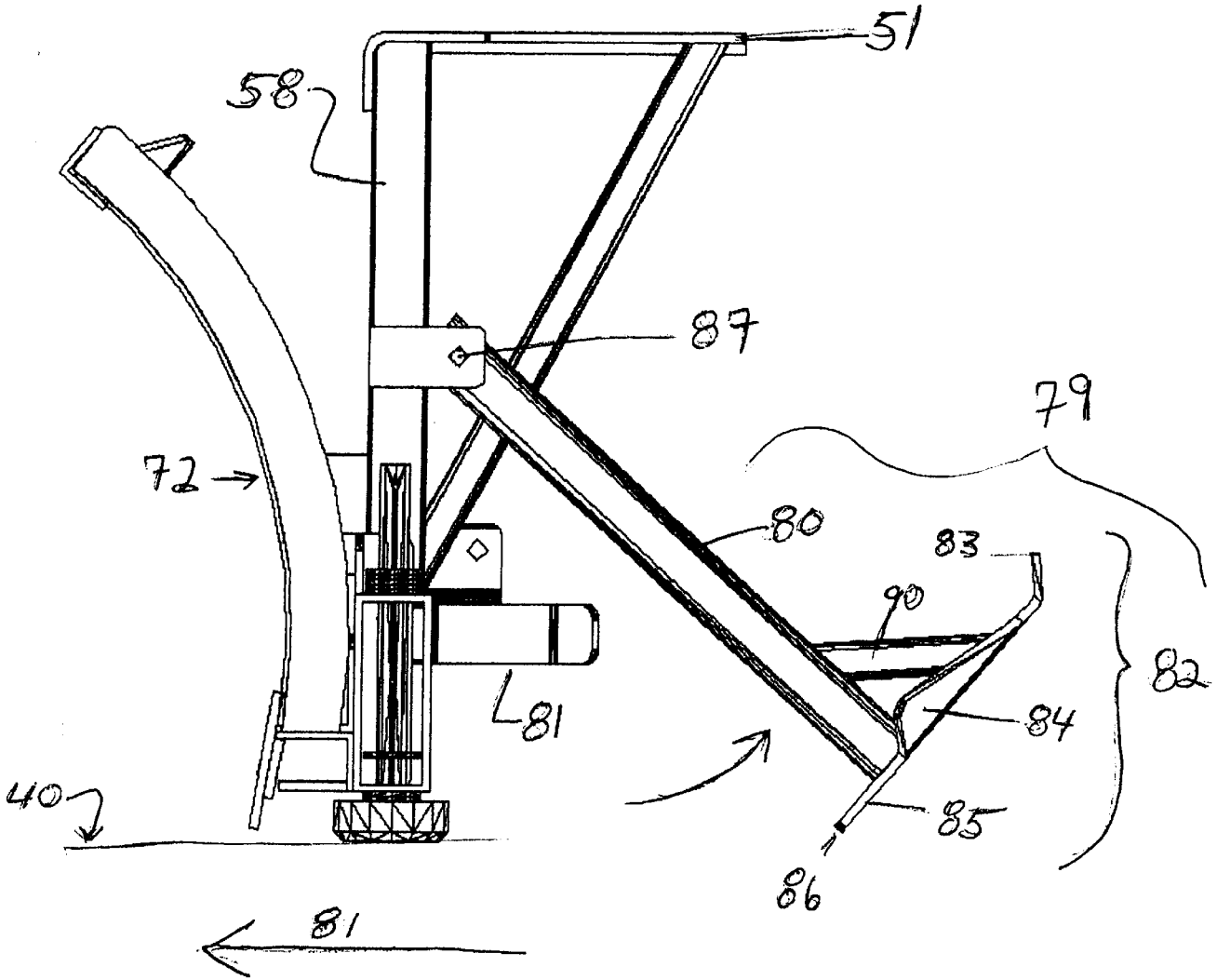
FIG. 10 is a side view of the snowplow blade of the present invention when the frictional activated mechanical elevator is in a non-elevated position.

FIG. 10 demonstrates the snowplow housing with the FAME in a plowing position as the skid plate 82 trails along the plowed surface 40. The arm 80 of the FAME is attached to the housing 58 and the novel skid plate 82 attached to the arm 80. The configuration of the toe 83 and the leading sides 84 of the skid plate 82 are illustrated. The struts 81attached to the housing 58 are also demonstrated. The struts 81 and the design of the skid plate 82 allow the oblique or lateral movement of the skid plates and the snowplow necessary for the operation of the snowplow of the current invention. If not for these two features, the attachment 87 of the arm 80 of the FAME to the housing member 58 would not tolerate the repeated multidirectional forces unique to the rear mounted plow of the current invention. Other prior art hitch ball mounted devices only push the snow in a rearward direction and do not angle the blade. Therefore means for elevating the blade in those instances need only engage when the vehicle travels in a forward direction. Moreover, the plow tends to trailer behind the vehicle without much lateral or oblique motion. In the snowplow of the current invention, the blade can be angled to either side and the plow preferentially is directed forward and towed by the vehicle. Therefore, the FAME is deployed by reversing the vehicle, and turning the front wheels of the vehicle while the vehicle is reversed will cause the rear mounted snowplow to travel in exaggerated oblique and lateral directions creating forces on the attachment 87 of the FAME not present in other designs. The struts 81 and the novel shape of the skid plate 82 solve this problem.

Figure 11:
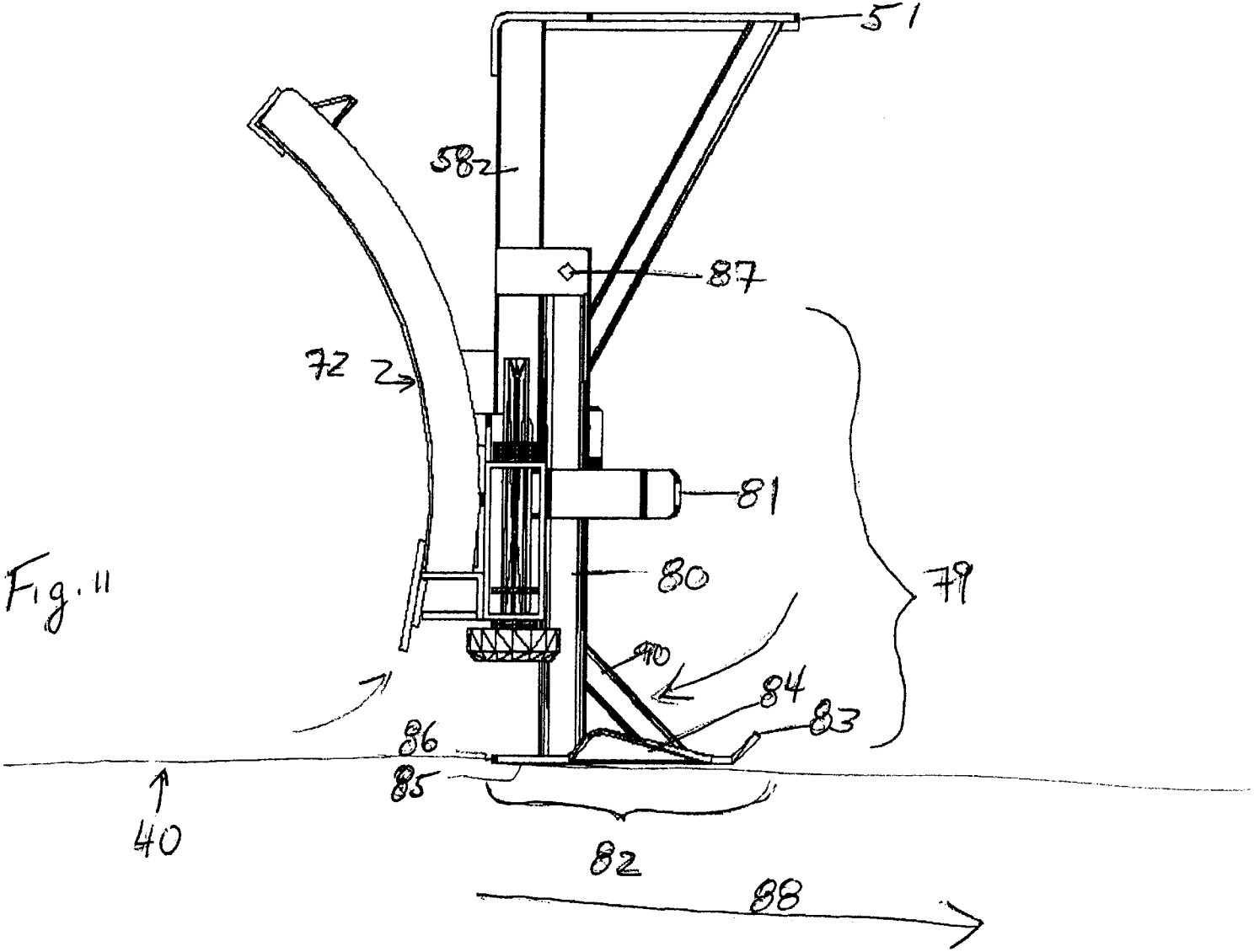
FIG. 11 is a side view of the snowplow blade when the frictional activated mechanical elevator is engaged and is elevating the blade off the ground.

FIG. 11 demonstrates the snowplow blade 72, the housing apparatus 50, and the FAME 79 while the snowplow is being reversed 88. Similar to the prior description of the preferred FAME 30, this alternate FAME 79 elevates the snowplow when the snowplow is directed in a non-plowing position 88. FIGS. 10 and 11 demonstrate the action of the FAME 79. The rear edge 86 of the skid plate 82 frictionally engages the ground 40 when the snowplow is reversed, and because the length of the arm 80 of the FAME 79 is greater than the distance from the attachment 87 of the arm 80 to the ground 40, the FAME 79 rotates toward the plow while elevating it (FIG. 11, arrows.) If the blade 72 were angled to one side, or if the vehicle were to reverse direction while turning, the angled elements 85 of the rear of the skid plate 82 would engage the ground 40, causing the above-described action. The snowplow then slides over the ground or unplowed snow on the skid plates 82 without dragging or spreading the snow. When the plow is directed forward, the appropriate rear edge 85 or 86 of the skid plate 82 engages and rotates the FAME 79 away from the plow and allows the plow blade 72 to lower to the ground in a configuration illustrated in FIG. 10.

Figure 12:
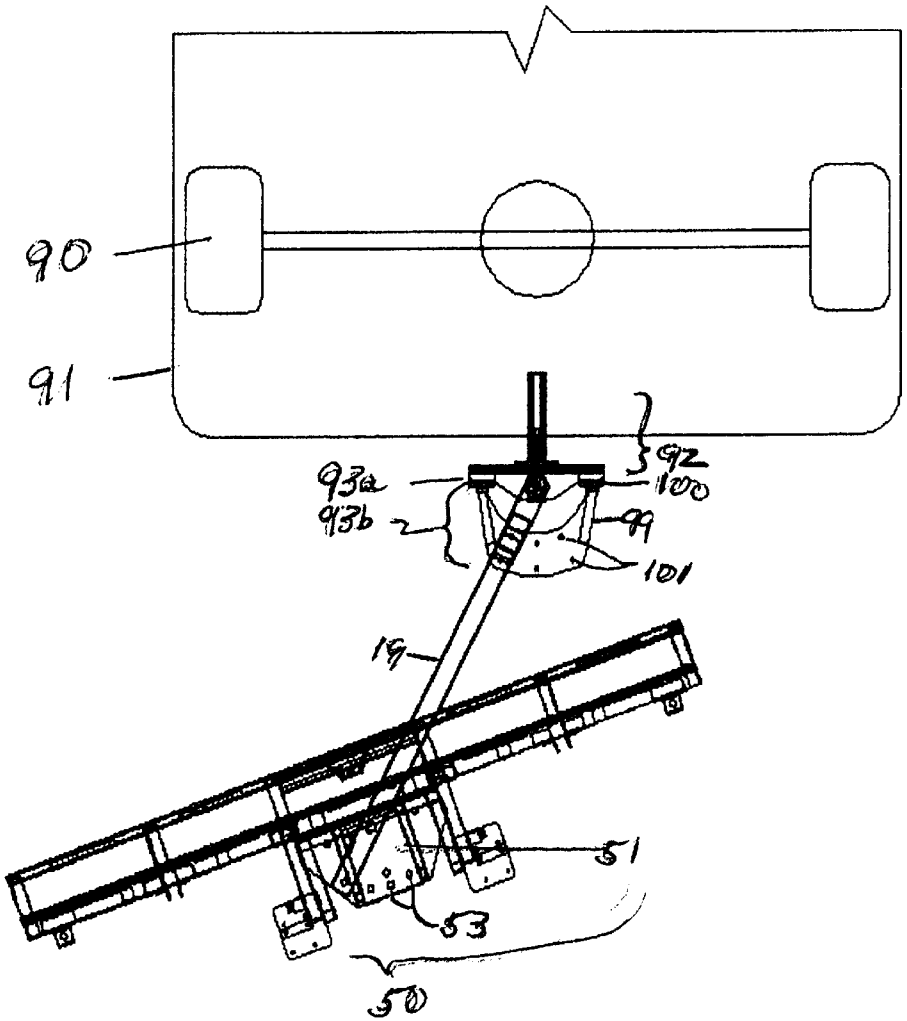
FIG. 12 is a top view of the present invention hitched to the rear of a vehicle.
Figure 13:
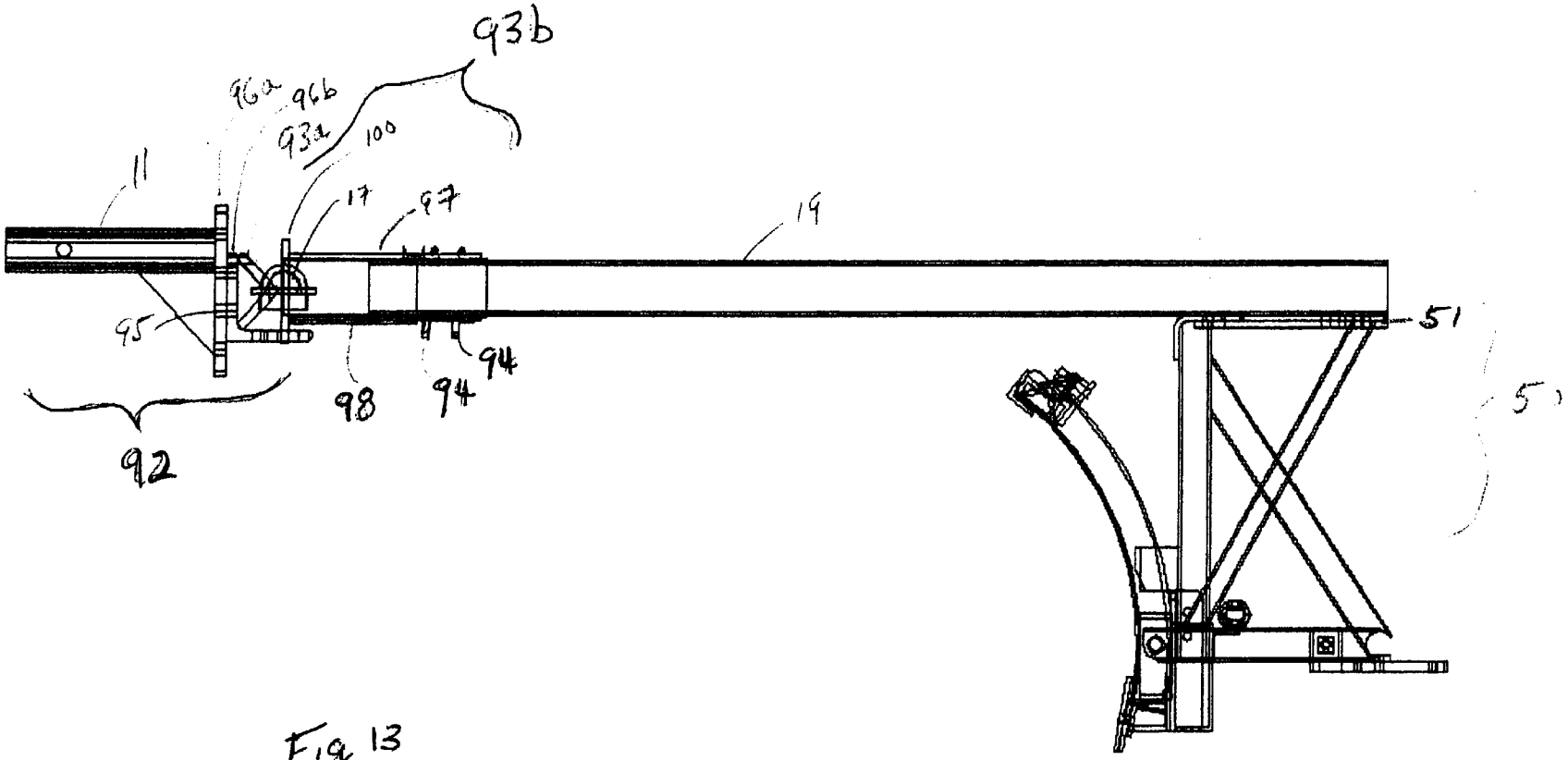
FIG. 13 is a side view of one embodiment of the present invention.
Figure 14:
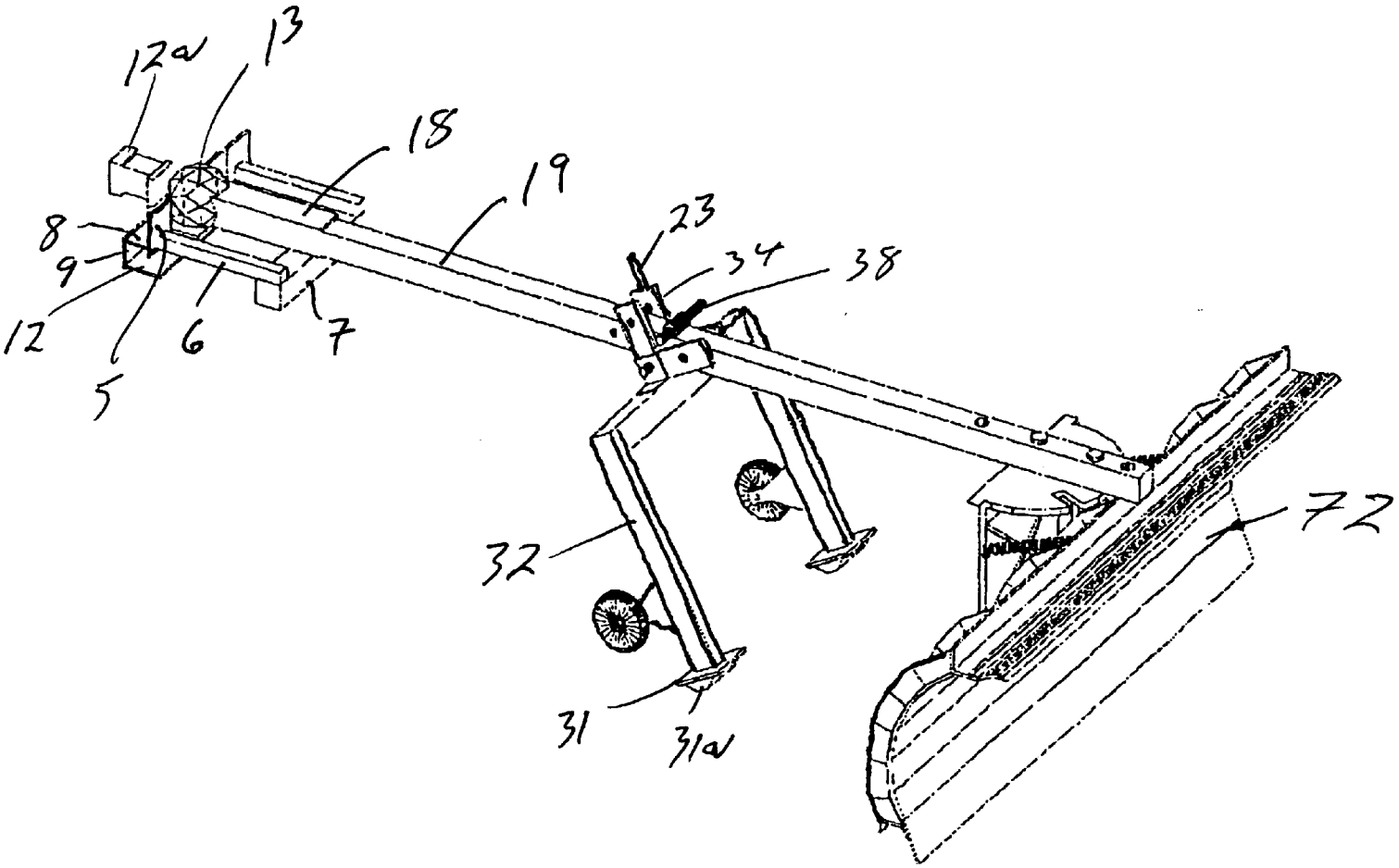
FIG. 14 is a perspective view of the present invention hooked to a ball trailer hitch and suitable for plowing when the vehicle is moved in reverse.
Figure 15:
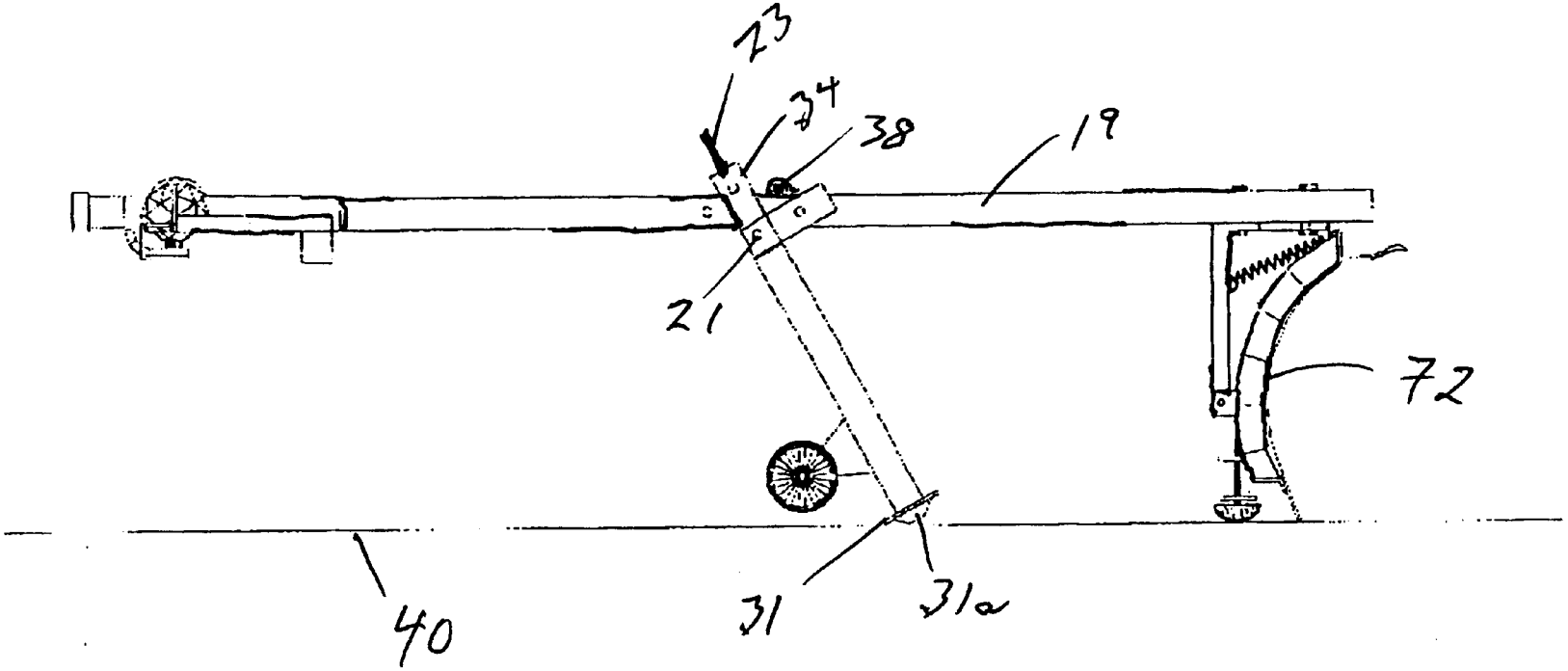
FIG. 15 is a side view of the invention as pictured in FIG. 14.
Figure 16:
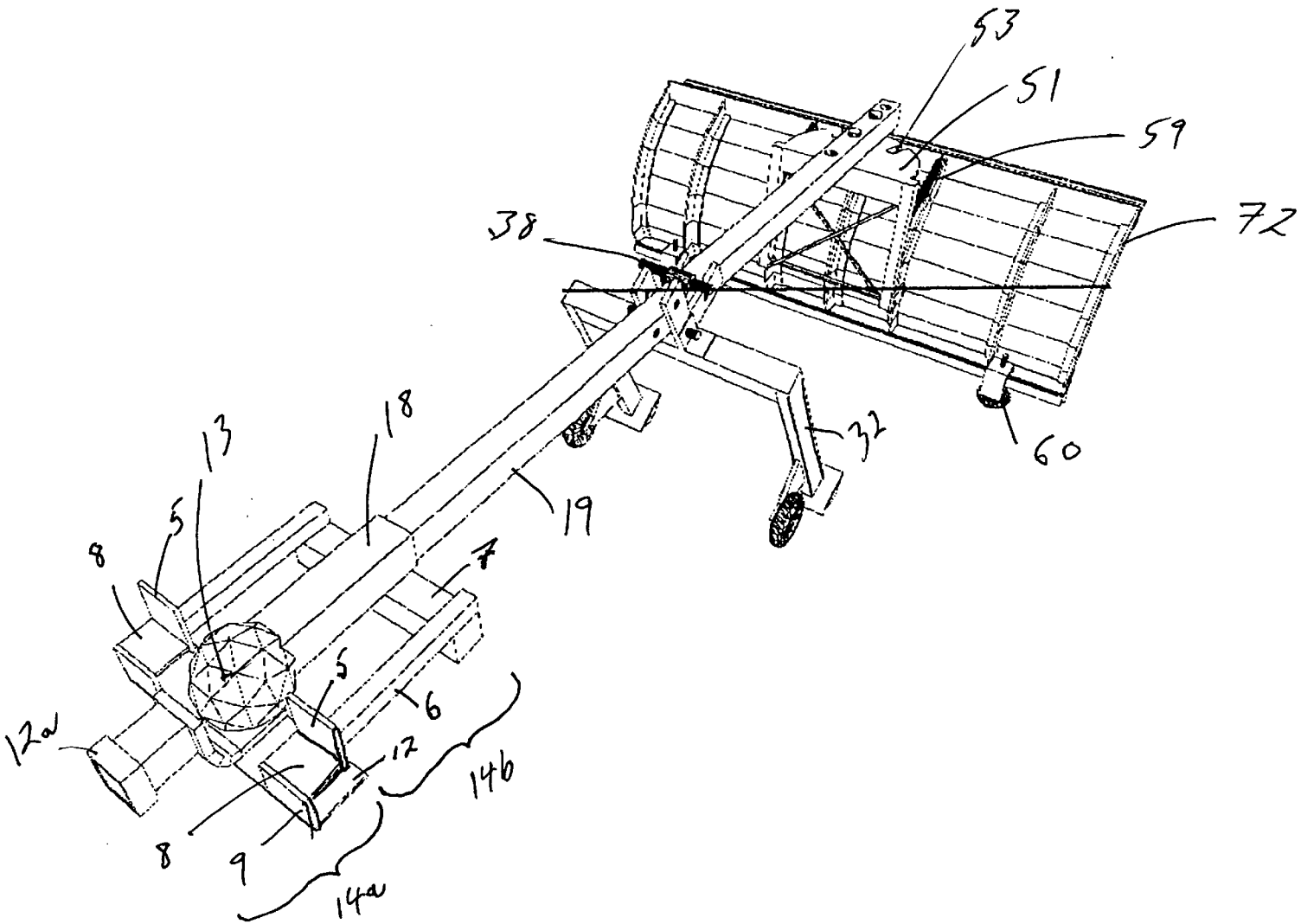
FIG. 16 is a top side perspective view of the embodiment pictured in FIG. 14.

FIGS. 12 and 13 illustrate an alternative lateral stabilization device that is attached directly to the hitch bar as well. The alternative lateral stabilization device allows the drawbar of the snowplow to be rotated to either side. This projects the snowplow beyond the wheel wells or tires 90 of the vehicle 91 by 18 to 24 inches, preferably. This orientation is useful in plowing snow in a forward towing motion along a ditch or road edge and obviates the danger of driving the vehicle into the ditch or off the road edge. It also allows snow to be cleared completely off the roadway or into a ditch. An alternative hitch bar component 92 is also provided which allows vertical adjustment of the hitch ball 17, as well as lateral stabilization components 93*a*. Corresponding lateral stabilization components 93*b* are affixed to the drawbar 19 by two pins 94 and abut the lateral stabilization components 93*a* of the hitch bar 11 by similar components 42*a* and 42*b* as described previously. The hitch bar assembly 92 is comprised of a hitch bar 11 which is placed into the receiver hitch of a vehicle 91. The hitch bar assembly can be welded to a vertical plate 96*a* containing holes 95 which can then be bolted to a second vertical plate 96*b*. This allows vertical adjustment of the ball 17 depending on the type of vehicle 91 being used. The lateral stabilization component 93*a* of the hitch bar 92 is preferably a V-shaped metal piece welded to the second vertical plate 96*b*. The apex of the "V" is positioned at the center axis of the ball 17.

The lateral stabilization component 93*b* of the drawbar 19 is comprised of top 97 and bottom 98 horizontal members which are welded to two vertical side members 99, which in turn is welded to a vertical end member 100 which abuts the stabilization component 93*a* of the drawbar 92. Two pins 94 are placed through holes 101 in members 97 and 98 of the drawbar stabilization device 93*b* and through holes in the drawbar 19 affixing it to the drawbar 19 in straight or angled orientations. The operator therefore may change the orientation and position of the blade 72 relative to the vehicle 91 by selecting holes 101 in the alternative lateral stabilization device 93*b* and by selecting holes 53 in the horizontal member 51 of the snowplow housing 50 as discussed previously. These features add flexibility not present in prior art devices.

As will be appreciated by one of skill in the art, the lateral stabilization device of the present invention can be of various configurations, all of such configurations sharing the attribute of being able to control the lateral movement of a drawbar, and thus a snowplow attached thereto, to prevent undesired angulation of the snowplow during either forward or rearward movement of the vehicle. Although in a preferred embodiment the stabilization components described are in particular configurations (e.g., stabilization members positioned approximately equal distance from a drawbar and substantially parallel therewith), one will appreciate that other configurations, such as angled stabilization members that are not necessarily parallel to each other, reinforced metal components preferably attached to a hitch bar, the hitch ball, or to the rear of a vehicle, so as to be in close physical position to counterpart stabilization members connected to a drawbar, are all within the scope of the present invention.

Yet another aspect of the present invention is directed to a method for plowing snow, comprising providing a snowplow blade with a friction activated elevator assembly; providing a connecting mechanism associated with the blade capable of attaching to a wheelbarrow or wheeled lawn cart; filling the wheelbarrow or lawn cart device with a desired amount of ballast; moving the wheelbarrow or lawn cart in a forward direction, thereby moving the snowplow blade in a forward ground contacting orientation; and reversing the direction of the wheelbarrow or lawn cart whereby the movement in the reverse direction causes the friction activated elevator to engage with the ground and to elevate the blade from the ground.

The snowplow of the present invention provides a light weight, inexpensive, effective snow removal device which is easy and simple to attach, which can be directed in forward or rearward directions and straight or angled directions, which provides for a bi-directional friction activated mechanical elevator which automatically lifts the blade off the plowed surface when not plowing, and which can be easily detached and rolled to a storage location. Users of either sex and of virtually any age without tools or mechanical aptitude can accomplish these actions in minutes with little physical effort.

In summary, the snowplow of the present invention, in the preferred embodiment, consists of several novel features which, when combined, create a device capable of the attributes listed above. The lateral stabilization apparati of the hitch bar and the drawbar allow for the desired motion of the snowplow blade while preventing unwanted side-to side motion. The bi-directional FAME apparatus elevates the plow blade when not plowing, whether that be in forward or rearward directions. The FAME also provides for easy deployment of wheels for local transport and attachment/detachment. Other FAME designs described herein provides elevator functions for the unique conditions caused by a forward towing position in a rear mounted plow. The snowplow blade and blade support apparatus allow the user to plow snow in forward or rearward directions with a straight or angled blade. The drawbar will also rotate parallel to and adjacent to the blade for compact storage.

The foregoing discussion of the invention has been presented for purposes of illustration and description. Further, the description is not intended to limit the invention to the form disclosed herein. Consequently, variation and modification commensurate with the above teachings, and within the skill and knowledge of the relevant art, are within the scope of the present invention. The embodiments described hereinabove is further intended to explain the best mode presently known of practicing the invention and to enable others skilled in the art to utilize the invention as such, or in other embodiments, and with the various modifications required by their particular application or uses of the invention. It is intended that the appended claims be construed to include alternative embodiments to the extent permitted by the prior art.

What is claimed is:

1. A snowplow apparatus adapted to be attached to a vehicle having a ball hitch assembly, comprising:

a. a blade assembly having a front face for effecting displacement of snow accumulated on the ground surface over which said blade assembly is caused to traverse, and a second back face having a blade support assembly operatively attached thereto;

b. an elongated drawbar having a first end and a second end, said first end operatively associated with a ball hitch assembly and said second end being operatively associated with said blade support assembly;

c. a frictionally activated elevating mechanism having top and bottom ends, said top end having a handle associated therewith, said top end being pivotally connected to said drawbar, said bottom end having a hardened plastic extension associated therewith for contacting the ground surface, said frictionally activated extension being movable between a first vertical position wherein said blade is elevated off the ground, and a second nonvertical orientation wherein said blade contacts the ground;

d. a lateral stabilization device operatively associated with said first end of said drawbar, said stabilization device comprising first and second stabilization members positioned approximately equal distance from said drawbar and substantially parallel therewith, said first and second members adjacent said hitch assembly; and e. a hitch ball operatively associated with a horizontal member, said horizontal member having first and second static elements, said first and second static elements configured to engage said first and second stabilization members when said ball hitch assembly is operatively associated with said hitch ball, whereby lateral movement of said drawbar is substantially precluded due to the contact between said first and second stabilization members and said first and second static elements.

2. The device as set forth in claim 1, wherein said blade can be rotated 180° to facilitate plowing when said vehicle is moved in a rearward direction.

3. The device as set forth in claim 1, further comprising at least one wheel assembly operatively associated with said elevator, said wheel assembly facilitating transport of said snowplow.

4. The device as set forth in claim 1, further comprising a spring connecting said blade to said blade support assembly to facilitate pivotable movement of said blade when said blade contacts obstacles during a plowing operation.

5. The device as set forth in claim 1, wherein said blade support assembly comprises a blade angulation plate rotationally associated with said longitudinal drawbar, enabling said blade to be moved and fixed in a desired angular orientation.

6. The device as set forth in claim 1, wherein said lateral stabilization device does not substantially preclude movement of said longitudinal drawbar in a vertical direction during a plowing operation.

7. The device as set forth in claim 1, further comprising at least two skid members operatively associated with a ground contacting portion of said blade.

8. The device as set forth in claim 1, wherein said lateral stabilization device provides for fixed angular orientation of said drawbar.

9. The device as set forth in claim 1, further comprising a handle fixedly connected to said top end of said frictionally activated elevating mechanism.

10. A snowplow apparatus adapted to be attached to a vehicle having a ball hitch assembly, comprising:

a. a blade assembly having a front face for effecting displacement of snow accumulated on the ground surface over which said blade assembly is caused to traverse, and a second back face having a blade support assembly operatively attached thereto;

b. an elongated drawbar having a first end and a second end, said first end operatively associated with a ball hitch assembly and said second end being operatively associated with said blade support assembly;

c. a frictionally activated elevating mechanism having top and bottom ends, said top end being pivotally connected to said second back face of said blade and said bottom end having a lip that engages the ground to cause said mechanism to attain a vertical position, and a substantially flat surface which contacts and slides over the ground surface, said frictionally activated extension being movable between said vertical position, wherein said blade is elevated off the ground, and a non-vertical orientation, wherein said blade contacts the ground;

d. a lateral stabilization device operatively associated with said first end of said drawbar, said stabilization device comprising first and second stabilization members positioned approximately equal distance from said drawbar and substantially parallel therewith, said first and second members adjacent said hitch assembly; and e. a hitch ball operatively associated with a horizontal member, said horizontal member having first and second hitch ball static elements, said first and second static elements configured to engage said first and second stabilization members when said ball hitch assembly is operatively associated with said hitch ball, whereby lateral movement of said drawbar is substantially precluded due to the contact between said first and second stabilization members and said first and second static elements.

11. The snowplow apparatus as set forth in claim 10, further comprising at least one strut providing support against lateral movement of said frictionally activated elevating mechanism when said mechanism is in said vertical position.

12. The snowplow apparatus as set forth in claim 10, wherein said bottom end of said frictionally activated elevating mechanism comprises a skid plate which has a turned-up toe and turned-up leading sides and a rear surface providing a frictionally engaging ground contacting surface.

13. A method for performing a snowplowing operation, comprising a. providing a blade assembly having a front face for effecting displacement of snow accumulated on the ground surface over which said blade assembly is caused to traverse, and a second back face having a blade support assembly operatively attached thereto;

b. providing an elongated drawbar having a first end and a second end, said first end operatively associated with a ball hitch assembly and said second end being operatively associated with said blade support assembly;

c. providing a frictionally activated elevating mechanism having top and bottom ends, said top end being pivotally connected to said second back face of said blade and said bottom end having a flat surface associated therewith for contacting the ground surface, said frictionally activated extension being movable between a first vertical position wherein said blade is elevated off the ground, and a second non-vertical orientation wherein said blade contacts the ground;

d. providing a lateral stabilization device operatively associated with said first end of said drawbar, said stabilization device comprising first and second stabilization members positioned approximately equal distance from said drawbar and substantially parallel therewith, said first and second members adjacent said hitch assembly; and e. providing a hitch ball operatively associated with a horizontal member, said horizontal member having first and second hitch ball static elements, said first and second static elements configured to engage said first and second stabilization members when said ball hitch assembly is operatively associated with said hitch ball, whereby lateral movement of said drawbar is substantially precluded due to the contact between said first and second stabilization members and said first and second static elements;

f. bringing said blade into contact with snow to be plowed and conveying said vehicle in a direction to accomplish said plowing operation.

14. A snowplow apparatus adapted to be attached to a vehicle having a ball hitch assembly, comprising:

a. a blade assembly having a front face for effecting displacement of snow accumulated on the ground surface over which said blade assembly is caused to traverse, and a second back face having a blade support assembly operatively attached thereto;

b. an elongated drawbar having a first end and a second end, said first end operatively associated with a ball hitch assembly and said second end being operatively associated with said blade support assembly;

c. a lateral stabilization device operatively associated with said first end of said drawbar, said stabilization device comprising stabilization members; and d. a hitch ball operatively associated with static elements configured to engage said stabilization members when said ball hitch assembly is operatively associated with said hitch ball, whereby lateral movement of said drawbar is substantially precluded due to the contact between said stabilization members and said static elements.

* * * * *